US005710112A

United States Patent [19]

Yaegashi et al.

[11] Patent Number: 5,710,112

[45] Date of Patent: Jan. 20, 1998

[54] LUBRICANT COMPOSITION

[75] Inventors: Ko Yaegashi; Yoshiaki Oikawa; Hiroshi Kamiyashiki; Hiroshi Kimura, all of Fujisawa, Japan

[73] Assignee: Kyodo Yushi Co., Ltd., Tokyo, Japan

[21] Appl. No.: 532,509

[22] Filed: Sep. 22, 1995

[51] Int. Cl.[6] ..... C10M 125/24; C10M 125/28; C10M 115/12

[52] U.S. Cl. ..... 508/159; 508/157; 508/163

[58] Field of Search ..... 252/18, 25; 508/159, 508/163, 157

[56] References Cited

U.S. PATENT DOCUMENTS

| | | | |
|---|---|---|---|
| 3,368,970 | 2/1968 | Grunze et al. | 508/163 |
| 3,907,692 | 9/1975 | Ullman et al. | 252/18 |
| 3,912,639 | 10/1975 | Adams | 252/18 |
| 3,912,643 | 10/1975 | Adams | 252/18 |
| 3,912,644 | 10/1975 | Adams | 252/18 |
| 4,068,513 | 1/1978 | Guerit et al. | 508/159 |
| 4,100,080 | 7/1978 | Adams | 252/18 |
| 4,554,084 | 11/1985 | Lonne et al. | 252/12.2 |
| 5,576,272 | 11/1996 | Okawa et al. | 508/159 |

FOREIGN PATENT DOCUMENTS 7041781 10/1995 Japan .

*Primary Examiner*—Margaret Medley

*Attorney, Agent, or Firm*—Oblon, Spivak, McClelland, Maier & Neustadt, P.C.

[57] ABSTRACT

A lubricant composition comprising from 0.1 to 10% by weight of a phosphate glass, characterized in that said phosphate glass comprises from 45 to 75 mole % of $P_2O_5$, from 10 to 35 mole % of $M_2O$ (M represents alkaline metals) and from 0 to 45 mole % of $B_2O_3$. Phosphate glasses are in the form of powder with white to ash-colored appearance, and do not cause dirt of working surroundings. Phosphate glasses are less expensive than solid lubricants which are conventionally used, and also excellent load carrying capacity can be attained by adding a small amount of phosphate glass to a lubricant composition. Accordingly, the lubricant composition of the present invention shows better load carrying capacity than a conventional lubricant composition.

6 Claims, No Drawings

LUBRICANT COMPOSITION

BACKGROUND OF THE INVENTION

The present invention relates to a lubricant composition and more specifically to a lubricant composition having an excellent load carrying capacity.

In this field, a solid lubricant such as graphite, molybdenum disulfide and organic molydenum, polytetrafluoroethlene (PTFE), and an addition product of melamine and cyanuric acid are conventionally added to lubricant compositions to improve load carrying capacity thereof.

However, since these solid lubricants are expensive, and further graphite and molydenum disulfide are black in their appeared, some problems are caused, for example this soil working surroundings at the time of lubricating oil supply (lubrication) and then the beauty of circumstance are marred.

SUMMARY OF THE INVENTION

Accordingly, an object oF the present invention is to provide a lubricant composition with excellent load carrying capacity comprising an extreme pressure agent which is less expensive than conventional solid lubricants, has almost white appearance, and does not cause dirt of working surroundings.

The inventors of the present invention made an effort to achieve the foregoing object, and then have found that the addition of a phosphate glass to a lubricant composition allows the lubricant composition to exhibit excellent lead carrying capacity. Phosphate glasses are in the form of powder with white to ash-colored appearance, and are less expensive than extreme pressure agents which are conventionally used. By adding a small amount of phosphate glass to a lubricant composition, excellent lead carrying capacity can be attained in the lubricant composition.

Accordingly, the present invention is directed to a lubricant composition comprising from 0.1 to 10% by weight of a phosphate glass.

In one of preferred embodiments according to the present invention, the phosphate glass comprises from 45 to 75 mole % of $P_2O_5$, from 10 to 35 mole % of $M_2O$ (M represent alkaline metals) and from 0 to 45mole % of $B_2O_3$.

A main component of the lubricant composition of the present invention may be a lubricating oil or a lubricating grease.

The lubricant composition of the present invention may be prepared in conventional manner, for example, by adding a phosphate glass to a lubricating oil or a lubricating grease and mixing the resulting mixture uniformly. Since a phosphate glass tends to readily precipitate in a lubricating oil, excellent load carrying capacity can be attained by adding finely pulverized phosphate glass, or using an additive which enhances dispersion of phosphate glass. The content of phosphate glass is from 0.1 to 10% by weight, preferably from 2.0 to 5.0% by weight on the basis of the total weight of the lubricant composition. If the content of phosphate glass is less than 0.1%, the desired effect is not attained. On the other hand, if it exceeds 10% by weight, further improvement on load carrying capacity cannot be expected and then it is not economical, and wear can be possibly accelerated.

The lubricating oil used in the lubricant composition according to the present invention is not restricted to specific ones, but example thereof include animal oils, vegetable oils, petroleum lubricating oils, synthetic lubricating oils and the like. The lubricating grease used in the lubricant composition according to the present invention is also not restricted to specific ones, and it may be a metallic soap based lubricating grease or non-metallic soap based lubricating grease. Examples of the lubricating grease include a lithium grease, an urea grease, a calcium grease, a lithium complex grease and the like.

The lubricant composition of the present invention may comprise additives which are generally incorporated into lubricants. Such additives include an antioxidant, a detergent dispersant, an oilness agent, a friction modifier, a viscosity index improver, a pour point depressant, a rust inhibitor and an antifoamer. These additives may be used in an amount which is generally employed.

The phosphate glass used in the present invention is suitably the one which comprises from 45 to 75 mole % of $P_2O_5$, from 10 to 35 mole % of $M_2O$ (N represents alkaline metals) end from 0 to 45 mole % of $B_2O_3$, and may further comprise $Al_2O_3$, $Ti_2O_3$, MgO, $SiO_2$ and the like.

Such phosphate glasses are commercially available under the trade names of, for example, M-1, L-5, SM-5, M-3, M-10, all of which are manufactured by Taihei Chemical Industrial Co., Ltd. More specifically, M-1 comprises 63 mole % of $P_2O_5$, 16 mole % of $Na_3O$, 19 mole % of $K_2O$ and 2 mole % of $B_2O_3$, L-5 comprises 48 mole % of $P_2O_5$, 10 mole % of $Na_3O$, 15 mole % of $K_2O$ and 7 mole % of $Ti_2O_3$, M-3 comprises 60 mole % of $P_2O_5$, 19 mole % of $Na_3O$ and 21 mole % of $K_2O$, and M-10 comprises 57 mole % of $P_2O_5$, 14 mole % of $Na_3O$, 17 mole % of $K_2O$ and 2 mole % of $B_2O_3$. SM-5 comprises P, Al, Na, F and the like as main components.

The phosphate glass used in the present invention can also be prepared by a conventional process in this field. For example, the phosphate glass may be prepared by mixing (a) at least one compound selected from phosphoric acid and a salt thereof, (b) at least one compound selected from alkaline metal carbonate, nitrate, sulfate and hydroxide, and (c) at least one compound selected from boric acid and a salt thereof so that the mixture of the above compounds (a), (b) and (c) contains from 45 and 75 mole % of $P_2O_5$, from 10 to 35 mole % of $M_2O$ (M represents alkaline metals) and from 0 to 45 mole % of $B_2O_3$; melting the resulting mixture; and then cooling the mixture to obtain the phosphate glass.

As raw materials for the phosphate glass, those which are normally used in the field may be employed.

Examples of compound (a) include phosphoric acid, a salt thereof such as sodium dihydrogenphosphate, potassium dihydrogenphosphate, sodium metaphosphate, disodium hydrogenphosphate, dipotassium hydrogenphosphate, condensed sodium phosphate and condensed potassium phosphate.

Examples of compound (b) include sodium carbonate, potassium carbonate, sodium nitrate, potassium nitrate, sodium sulfate, potassium sulfate, sodium hydroxide and potassium hydroxide.

Examples of compound (c) include boric acid, a salt thereof such as sodium borate and potassium borate.

The above compounds (a) , (b) and (c) may be used in the form of powder, a solution in water, or a suspension in water.

The phosphate glass used in the lubricant composition according to the present invention is in the form of powder with white to ash-colored appearance. It does not cause dirt of working surroundings, and is loss expensive than extreme pressure agents which are conventionally used. Further, it is possible to attain excellent load carrying capacity by adding only a small amount of the phosphate glass to a lubricant composition. The lubricant composition of the present invention shows higher load carrying capacity than a conventional lubricant composition.

The present invention will be explained in more detail with reference to working Examples and Comparative Examples.

Examples 1 to 11 and Comparative Examples 1 to 10

According to formulations listed in the following Tables 1 to 3, lubricant compositions were prepared by adding an extreme pressure agent to a lubricating grease or lubricating oil and then mixing. The content of each component is represented percent (%) by weight on the basis of the total weight of a lubricant composition.

The components used are as follows:

Lithium grease:

A lithium soap, main component of which is lithium 12-hydroxystearate, is used as a thickener and a mineral oil is used as a base oil.

Urea grease:

An urea compound synthesized from MDI (4,4'-diphenylmethyl diisocyanate) and octyl amine is used as thicker, and a mineral oil is used as a base oil.

Calcium grease:

A calcium soap, main component of which is calcium 12-hydroxystearate, is used as a thickener and a mineral oil is used as a base oil.

Lithium complex greases:

As a thickener, there is used a lithium complex soap which consists of a lithium soap comprising lithium 12-hydroxystearate as a main component and lithium azelate. A mineral oil is used as a base oil.

Mineral oil:

Kinematic viscosity thereof at 40° C. and 100° C. are 103.4 $m^3/s$ and 11.4 $m^2/s$, respectively. "Fukkol NT-500" (available from FUJI KOSANA CO., LTD.)

Phosphate glass:

M-1, L-5 and SM-5 (each product is manufactured by Taihei Chemical Industrial Co., Ltd. The compositions thereof are as described above.).

Molybdenum disulfide:

"NICHIMOLY M-5" (manufactured by NICHIMOLY DIVISION OSAKA SHIPBUILDIN CO., LTD.) refered to as MoS, in Table 3.

Organic molybdenum:

"SAKURA LUBU 600" (manufactured by ASHAI KOGYO DENKA K.K.) referred to as orgnic Mo in Table 3.

Graphite:

"GRAPHITE KS-15" (manufactured by LONZA JAPAN LTD (TIMCAL G+L LTD., SWISS)).

PTFE:

Polytertfluoroethylene "DAIXIN-POLYFLON TFE LOW POLYMER L-5F" (manufactured by DAIKIN INDUSTRIES, LTD).

These lubricant compositions were examined for load carrying capacity using Four-ball EP in accordance with the method of ASTM D 2596, and then L.N.S.L. (Last Non Seisure Load), W.P. (Weld Point) and L.W.I. (Load Wear Index) were determined. The results thus obtained are also summarized in the following Tables 1 to 3.

TABLE 1

| | Example | | | | | |
|---|---|---|---|---|---|---|
| Component | 1 | 2 | 3 | 4 | 5 | 6 |
| lithium grease | 99.8 | 99.5 | 99.0 | 97.5 | — | — |
| urea grease | — | — | — | — | 97.5 | — |
| calcium grease | — | — | — | — | — | 97.5 |
| lithium complex grease | — | — | — | — | — | — |
| mineral oil | — | — | — | — | — | — |
| Phosphate glass | | | | | | |
| M-1 | 0.20 | 0.5 | 1.0 | 2.5 | 2.5 | 2.5 |
| L-5 | — | — | — | — | — | — |
| SM-5 | — | — | — | — | — | — |
| Four-ball EP (kgf) | | | | | | |
| L.N.S.L | 100 | 126 | 160 | 160 | 160 | 160 |
| W.P. | 315 | 315 | 400 | 800< | 800< | 800< |
| L.W.I. | 45 | 60 | 80 | 148< | 148< | 148< |

TABLE 2

| | Example | | | | |
|---|---|---|---|---|---|
| Component | 7 | 8 | 9 | 10 | 11 |
| lithium grease | — | 95.0 | 97.5 | 97.5 | — |
| urea grease | — | — | — | — | — |
| calcium grease | — | — | — | — | — |
| lithium complex grease | 97.5 | — | — | — | — |
| mineral oil | — | — | — | — | 97.5 |
| Phosphate glass | | | | | |
| M-1 | 2.5 | 5.0 | — | — | 2.5 |
| L-5 | — | — | 2.5 | — | — |
| SM-5 | — | — | — | 2.5 | — |
| Four-ball EP (kgf) | | | | | |
| L.N.S.L. | 160 | 160 | 100 | 160 | 80 |
| W.P. | 800< | 800< | 315 | 400 | 500 |
| L.W.I. | 148< | 167< | 57 | 72 | 96 |

TABLE 3

| | Comparative Example | | | | | | | | | |
|---|---|---|---|---|---|---|---|---|---|---|
| Component | 1 | 3 | 3 | 4 | 5 | 6 | 7 | 8 | 9 | 10 |
| lithium grease | 95.0 | 95.0 | 97.5 | 95.0 | 95.0 | — | — | 100 | — | — |
| urea grease | — | — | — | — | — | 95.0 | — | — | 100 | — |
| mineral oil | — | — | — | — | — | — | 95.0 | — | — | 100 |
| $MoS_2$ | 5.0 | — | — | — | — | 5.0 | 5.0 | — | — | — |
| organic Mo | — | 5.0 | 2.5 | — | — | — | — | — | — | — |

TABLE 3-continued

| | Comparative Example | | | | | | | | | |
|---|---|---|---|---|---|---|---|---|---|---|
| Component | 1 | 3 | 3 | 4 | 5 | 6 | 7 | 8 | 9 | 10 |
| graphite | — | — | — | 5.0 | — | — | — | — | — | — |
| PTFE | — | — | — | — | 5.0 | — | — | — | — | — |
| Four-ball EP (kgf) | | | | | | | | | | |
| L.N.S.L. | 63 | 80 | 63 | 63 | 63 | 80 | 80 | 63 | 63 | 63 |
| W.P. | 313 | 315 | 250 | 200 | 160 | 315 | 315 | 160 | 200 | 160 |
| L.W.I. | 40 | 48 | 38 | 29 | 32 | 45 | 48 | 23 | 31 | 28 |

As seen from the results listed in Tables 1 to 3, the lubricant compositions according to the present invention have better load carrying capacity than the lubricant compositions of comparative Examples.

What is claimed is:

1. A lubricant composition comprising a lubricating oil or lubricating grease, and from 0.1 to 10% by weight of a phosphate glass on the basis of the total weight of the lubricant composition, said phosphate glass comprising from 45 to 75 mole % of $P_2O_5$, from 10 to 35 mole % of $M_2O$ wherein M is an alkali metal, and from 0 to 45 mole % of $B_2O_3$.

2. The lubricant composition of claim 1 wherein the lubricant oil is selected from an animal oil, a vegetable oil, a petroleum lubricating oil, a synthetic lubricating oil and a mineral oil.

3. The lubricant composition of claim 1 wherein the lubricating grease is selected from a lithium grease, an urea grease, a calcium grease and a lithium complex grease.

4. The lubricant composition of claim 1 which comprises from 2.0 to 5% by weight of a phosphate glass on the basis of the total weight of the lubricant composition.

5. The lubricant composition of claim 2 which comprises from 2.0 to 5.0% by weight of a phosphate glass on the basis of the total weight of the lubricant composition.

6. The lubricant composition of claim 3 which comprises from 2.0 to 5.0% by weight of a phosphate glass on the basis of the total weight of the lubricant composition.

* * * * *